US008640926B2

(12) United States Patent
McNulty et al.

(10) Patent No.: US 8,640,926 B2
(45) Date of Patent: Feb. 4, 2014

(54) DISPENSER WITH FLEXIBLE COVER

(75) Inventors: John James McNulty, Broadview Heights, OH (US); Robert L. Quinlan, Stow, OH (US); David James Smith, Brockway, PA (US)

(73) Assignee: GOJO Industries, Inc., Akron, OH (US)

( * ) Notice: Subject to any disclaimer, the term of this patent is extended or adjusted under 35 U.S.C. 154(b) by 204 days.

(21) Appl. No.: 12/939,317

(22) Filed: Nov. 4, 2010

(65) Prior Publication Data

US 2012/0111891 A1 May 10, 2012

(51) Int. Cl.
*A47K 5/12* (2006.01)
*B65D 35/28* (2006.01)

(52) U.S. Cl.
USPC ..... 222/181.3; 222/214; 222/207; 222/182; 222/105

(58) Field of Classification Search
USPC ..... 222/207, 214, 181.2, 181.3, 182, 183, 222/103, 105; 239/327, 330
See application file for complete search history.

(56) References Cited

U.S. PATENT DOCUMENTS

| | | | | |
|---|---|---|---|---|
| 4,962,870 | A | 10/1990 | Schneider | |
| 5,377,880 | A | 1/1995 | Moretti | |
| 5,421,489 | A * | 6/1995 | Holzner et al. | 222/207 |
| 5,697,525 | A | 12/1997 | O'Reilly et al. | |
| 5,803,315 | A | 9/1998 | Kaufman | |
| 5,806,717 | A * | 9/1998 | De Rosenzeig-Page et al. | 222/105 |
| 5,862,956 | A * | 1/1999 | Brandenburg et al. | 222/214 |
| 5,975,372 | A * | 11/1999 | Heyn | 222/181.3 |
| 6,216,916 | B1 * | 4/2001 | Maddox et al. | 222/105 |
| 6,247,621 | B1 | 6/2001 | Lewis | |
| 6,619,512 | B1 * | 9/2003 | Sayers et al. | 222/207 |
| 7,000,806 | B2 | 2/2006 | Py | |
| 7,806,301 | B1 * | 10/2010 | Ciavarella et al. | 222/207 |
| 8,091,738 | B2 * | 1/2012 | Ciavarella | 222/181.3 |
| 2005/0247737 | A1 * | 11/2005 | Armstrong | 222/214 |
| 2009/0032554 | A1 | 2/2009 | Laidler | |

FOREIGN PATENT DOCUMENTS

| | | | |
|---|---|---|---|
| GB | 2 033 470 | A | 5/1980 |
| WO | WO 98/30492 | A1 | 7/1998 |
| WO | WO 00/53072 | A1 | 9/2000 |

OTHER PUBLICATIONS

International Search Report & Written Opinion for International application No. PCT/US2011/058707; dated Feb. 9, 2012; 16 pages.

* cited by examiner

*Primary Examiner* — Paul R Durand
*Assistant Examiner* — Charles P Cheyney
(74) *Attorney, Agent, or Firm* — Renner Kenner Greive Bobak Taylor & Weber

(57) ABSTRACT

A fluid dispenser including a backplate and a flexible cover fixedly secured to the backplate. A refill unit including a product reservoir and a pump is positioned within the dispenser and is carried by the backplate. The flexible cover is adapted to flex or deform when pressed by a user to actuate the pump, thereby alleviating the need for separate actuating members or pivoting of the cover.

12 Claims, 7 Drawing Sheets

DISPENSER WITH FLEXIBLE COVER

FIELD OF THE INVENTION

The present invention is generally directed to dispensing systems. In particular, the present invention is directed to a dispenser having a flexible cover that deforms to actuate a pump within the dispenser.

BACKGROUND OF THE INVENTION

It is well known to provide fluid dispensers for use in restaurants, factories, hospitals, bathrooms and the home. These dispensers may contain one of a number of fluids such as, for example, soap, antibacterial cleansers, disinfectants, lotions and the like. The dispensers may directly hold a quantity of fluid, but such dispensers have been found to be both messy and difficult to service. As a result, refill bags or containers that hold a quantity of fluid and provide a pump and nozzle mechanism have become increasingly popular. The refill bags or containers are advantageous in that they are easily installed and replaced and create virtually no mess.

Known dispensers may include a manual pump actuation mechanism, which requires a user to push or pull a lever to dispense a quantity of fluid, as will be understood by those skilled in the art. Alternatively, "hands-free" dispensers may be utilized where the user simply places one or both hands underneath a sensor and a quantity of fluid is dispensed. Similar types of dispensers may also be used to dispense powder or aerosol materials.

In the case of manually operated pump actuation mechanisms, prior art systems typically include a separate push bar or a pivoting cover to cause actuation of the pump. In either case, a mechanism to allow pivoting of either the push bar or the cover is required to generate the necessary movement to actuate the pump. In some cases, a system is provided to convert the movement of the push bar or cover into a pump actuating force. The added components required for the pivoting cover and separate push bar complicate the design of the dispensers, and increase the cost of manufacturing. Furthermore, the components of prior art actuating mechanisms provide a point of possible failure after repeated use of the dispenser.

Thus, there is a need for a dispenser having a simple and durable actuating mechanism.

SUMMARY OF THE INVENTION

In light of the foregoing, it is the first aspect of the present invention to provide a dispenser having a flexible cover.

It is another aspect of the present invention to provide such a dispenser wherein the cover is fixedly attached to the backplate of the dispenser.

The dispenser of the present invention may generally be described by the following clauses, or combinations of one or more of the following clauses:

A. A dispenser comprising: a backplate including a generally planar mounting portion; and a flexible cover fixedly secured to the backplate and capable of deforming under pressure, wherein the cover is fixedly secured to the backplate so that it cannot pivot relative to the backplate.

B. A dispenser comprising: a backplate including a generally planar mounting portion, a shelf portion extending generally perpendicularly from the mounting portion, and a pump support portion extending generally perpendicularly from the shelf portion opposite the mounting portion, a refill unit including a product reservoir and a pump in fluid communication with the product reservoir, and a flexible cover secured to the backplate and capable of deforming under pressure, wherein the cover is fixedly attached to the backplate.

C. A dispenser comprising: a backplate having sidewalls and channels in an outer surface of each side wall, a flexible cover including a front surface, sidewalls, a top surface, an abbreviated bottom surface and cut out slots in each side wall, and inwardly extending projections on an interior surface of each sidewall, the projections being received in the channels, wherein the cover is flexible and deformable by application of pressure to the front surface.

D. The dispenser of any preceding clause, further comprising a refill unit supported by the backplate and including a product reservoir and a pump.

E. The dispenser of any preceding clause, wherein the pump is a dome pump.

F. The dispenser of any preceding clause, wherein the backplate further includes a shelf portion extending generally perpendicularly from the mounting portion, and a pump support portion extending generally perpendicularly form the shelf portion opposite mounting portion.

G. The dispenser of any preceding clause, wherein the cover includes an inwardly extending actuating projection.

H. The dispenser of any preceding clause, wherein the actuating projection is positioned adjacent to the pump.

I. The dispenser of any preceding clause, further comprising laterally spaced sidewalls extending from the backplate along edges thereof.

J. The dispenser of any preceding clause, further comprising channels in an outer surface of the sidewalls, wherein the cover includes inwardly extending projections received in the channels.

K. The dispenser of any preceding clause, wherein the cover includes a front surface, a top surface, opposing side surfaces, and an abbreviated bottom surface.

L. The dispenser of any preceding clause, wherein the side surfaces of the cover each include a cut-out portion, the cut-out portions defining a flex point at which the cover bends.

M. The dispenser of any preceding clause, wherein the backplate has a tapered design so that the width of the backplate decreases adjacent a bottom edge thereof.

N. The dispenser of any preceding clause, wherein the cover has a corresponding tapered shape so that the width of the cover decreases adjacent a bottom edge thereof.

O. The dispenser of any preceding clause, wherein the cover deforms sufficiently under approximately 5 pounds of force to actuate the pump.

P. The dispenser of any preceding clause, further comprising laterally spaced slots in the cover, the slots extending from the bottom surface of the cover toward the top surface of the cover and terminating at ends spaced a distance from the top surface to define an actuating arm between the slots.

Q. The dispenser of any preceding clause, wherein a living hinge is provided between the ends of the slots.

DETAILED DESCRIPTION OF ILLUSTRATIVE EMBODIMENTS

Figure 1:
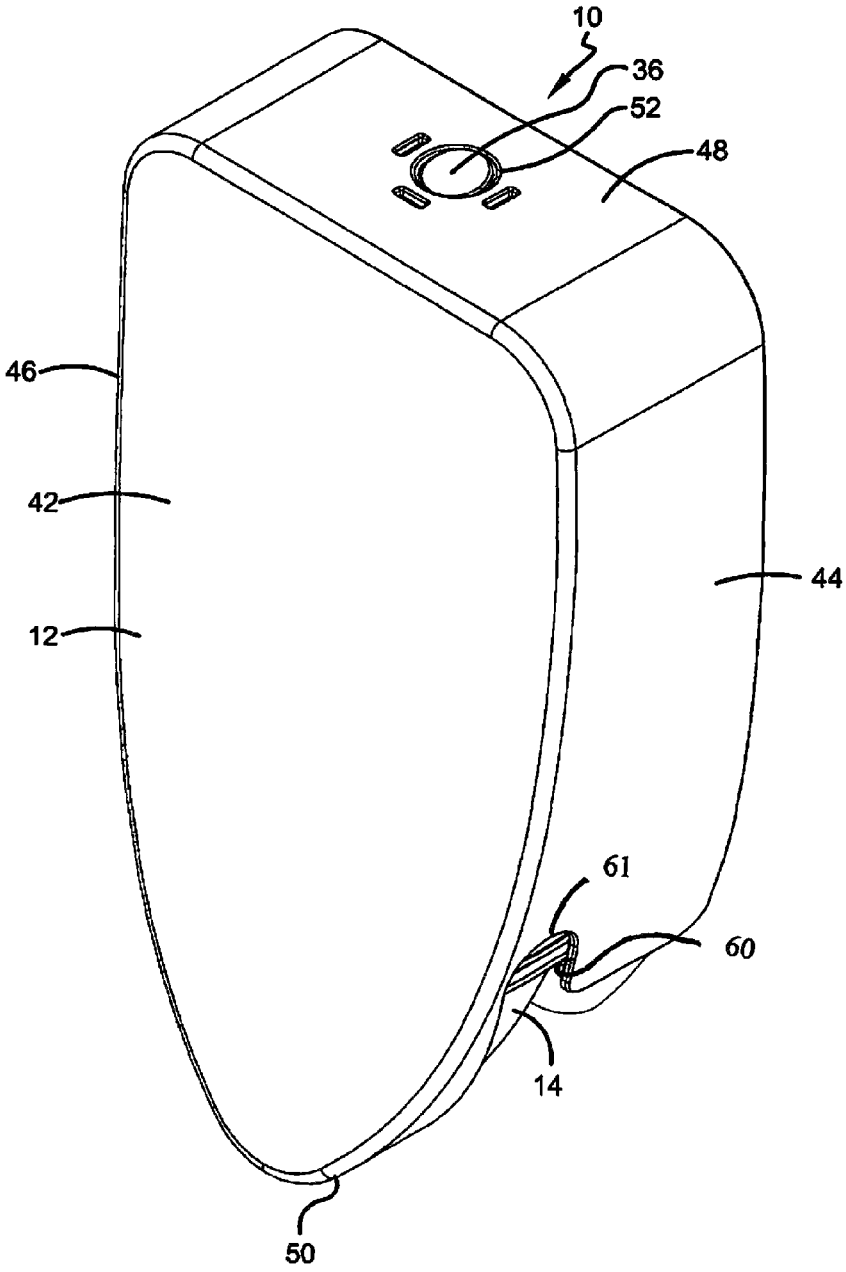
FIG. 1 is a perspective view of a dispenser according to the concepts of the present invention.
Figure 2:
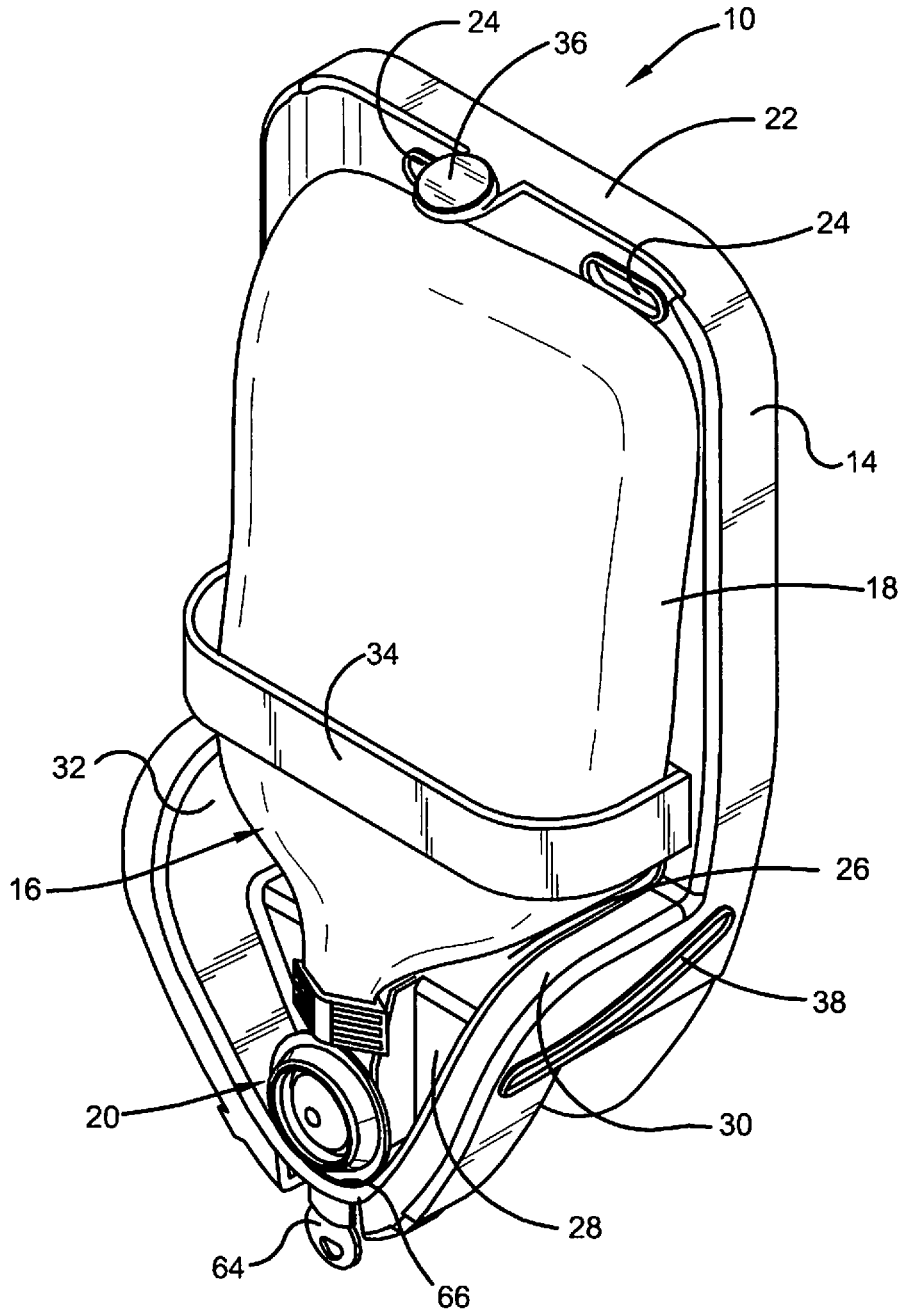
FIG. 2 is a perspective view of the dispenser of FIG. 1 with the flexible cover removed.
Figure 3:
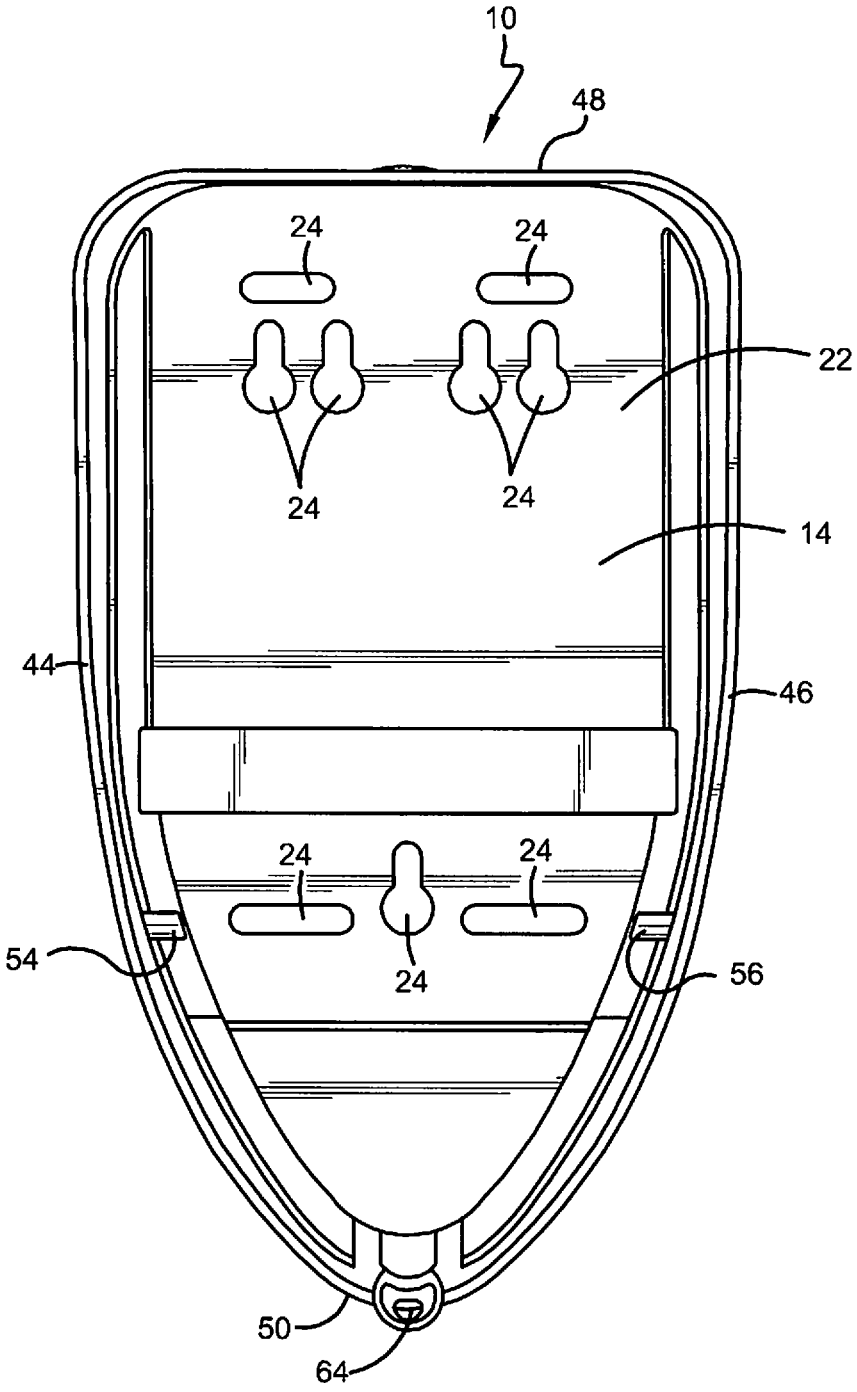
FIG. 3 is a rear view of the backplate of the dispenser.

Referring now to FIGS. 1-3, a dispenser is shown and is generally indicated by the numeral 10. Dispenser 10 includes a flexible cover 12 fixedly secured to a backplate 14. As used herein, fixedly secured should be interpreted as being secured in such a way as to prevent any significant movement of the cover 12 relative to backplate 14 except for flexing or deformation of cover 12 and complete removal of cover 12. Thus, no pivoting of cover 12 relative to backplate 14 is permitted when the cover is fixedly secured.

A refill unit 16 (FIG. 2) is positioned within dispenser 10 and includes a product reservoir 18 and a pump 20. As it is well known in the art, product reservoir 18 contains a fluid to be dispensed and is in fluid communication with pump 20. Any fluid known to those skilled in the art may be provided in product reservoir 18, including, for example, soap, anti-bacterial cleansers, disinfectants, lotions and the like. When empty, refill unit 16 may easily be replaced with a new unit, and the empty unit may be discarded, or, preferably, recycled.

Backplate 14 includes a generally planar mounting portion 22 adapted to be secured to a mounting surface. One or more apertures 24 may be provided in mounting portion 22 to facilitate the attachment of backplate 14 to a mounting surface. A shelf portion 26 extends generally perpendicularly from a bottom of mounting portion 22 to define a support surface for refill unit 16. Backplate 14 also includes a pump support portion 28 extending generally perpendicularly from shelf portion 26 opposite mounting portion 22. Pump support portion 2S supports pump 20 in a horizontal direction by preventing movement of the pump when it is actuated by the cover, as will be described herein.

Sidewalls 30 and 32 are provided at the lateral edges of mounting portion 22, shelf portion 26, and pump support portion 28. Thus, sidewalls 30, 32 extend substantially from the top of backplate 14 to the bottom of backplate 14. Backplate 14 may also include a product reservoir retaining element 34 extending therefrom and adapted to help retain the product reservoir 18 in the desired location. In the embodiment shown, the product reservoir retaining element 34 is generally U-shaped with its opposing ends secured to sidewalls 30, 32, and is spaced vertically from shelf portion 26.

Backplate 14 may also include a latch mechanism 36 extending therefrom and adapted to engage the cover 12. In addition, backplate 14 may include channels, such as channel 38 (channel on opposed side not seen) formed in the outer surface of sidewalls 30, 32 to assist in positioning cover 12 on backplate 14, as will be described in greater detail below. Backplate 14 may be provided with any desired shape or other aesthetic features as desired. In the embodiment depicted in the drawings, backplate 14 narrows in width from a height adjacent to shelf portion 26 to the bottom edge of backplate 14. This design has been found to provide the smallest footprint of the dispenser while still allowing for adequate space for the refill unit. However, it is contemplated that backplate 14 and cover 12 may also be provided in generally rectangular shapes, as is well known in the art.

Cover 12 includes a front surface 42, sidewalls 44, 46, top surface 48, and an abbreviated bottom surface 50. As will be appreciated by those skilled in the art, cover 12 is sized to fit over backplate 14. Top surface 48 includes an opening 52 that receives latch member 36 of backplate 14. As with backplate 14, cover 12 may be provided in any desired shape. In the specific embodiment shown and described herein, cover 12 narrows in width near the bottom edge corresponding to the shape of backplate 14. Cover 12 may also be concave in shape so that the front surface 42 adjacent to bottom surface 50 projects further from the mounting surface to which backplate 14 is attached than front surface 42 adjacent to top surface 48. This slight concave shape facilitates actuation of the dispenser, and allows for adequate space for the pump 20 therein.

Cover 12 includes projections 54, 56 extending inwardly from sidewalls 44, 46 that are received in the aforementioned channels, such as channel 38. The projections 54, 56 help to properly position cover 12 on backplate 14, and to secure the cover 12 against unintended movement. Cover 12 may further include an actuating projection 58 extending inwardly from front surface 42 and adapted to contact pump 20. Cover 12 is made of a flexible material and is adapted to deform when depressed by a user to actuate pump 20. As used herein, flexible material refers to a material that has elasticity, or is capable of flexing or deforming when subjected to a force typically applied to actuate a liquid dispenser. In certain embodiments, the force 15 applied to cause such deflection or deformation may be between 1 and 6 pounds of force. Suitable materials will be apparent to those skilled in the art, and the invention should not be limited to a specific material.

In order to facilitate the desired deformation of cover 12 when pressed, cut-outs 60, 62 may be provided in each side wall 44, 46 of cover 12. Cut-outs 60 and 62 and help to define a flex point in cover 12 so that the lowest portion of front surface 42 flexes toward backplate 14 at approximately the vertical tops 61, 63 of cut-outs 60, 62. Projections 54, 56 also engage the rear end of the aforementioned channels 38 (channel on opposed side not seen) to prevent the upper portion of cover 12 from moving relative to backplate 14 when the lower portion of cover 12 is pressed by a user.

Figure 4:
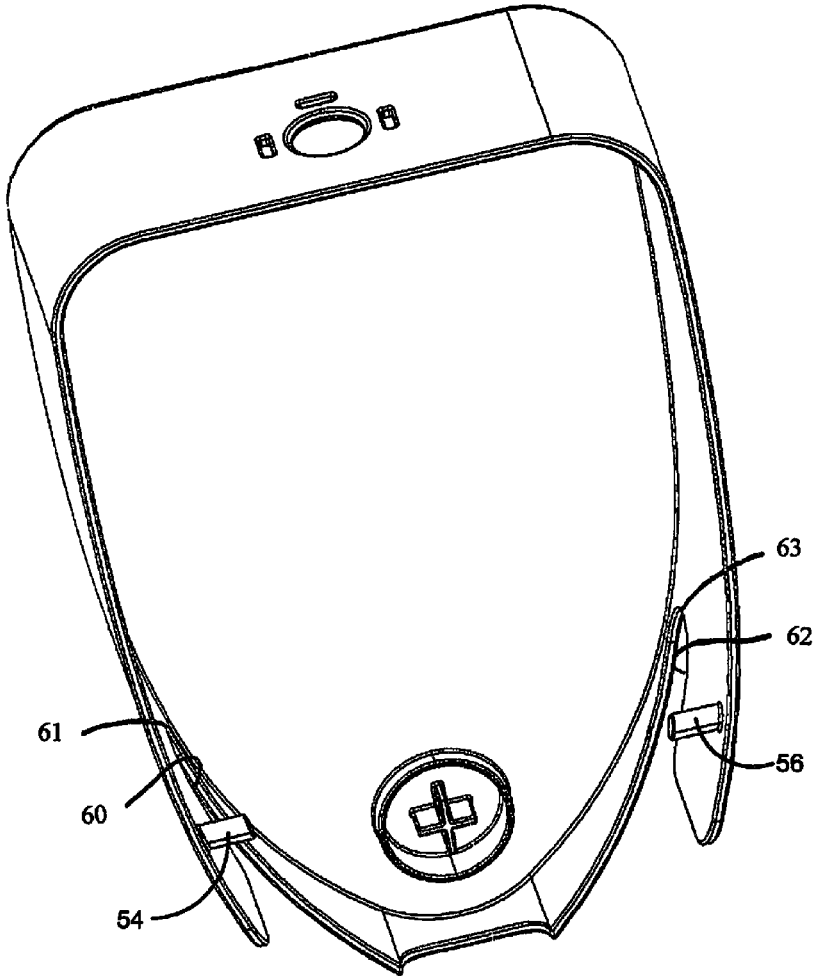
FIG. 4 is a perspective view of the flexible cover of the dispenser.
Figure 5:
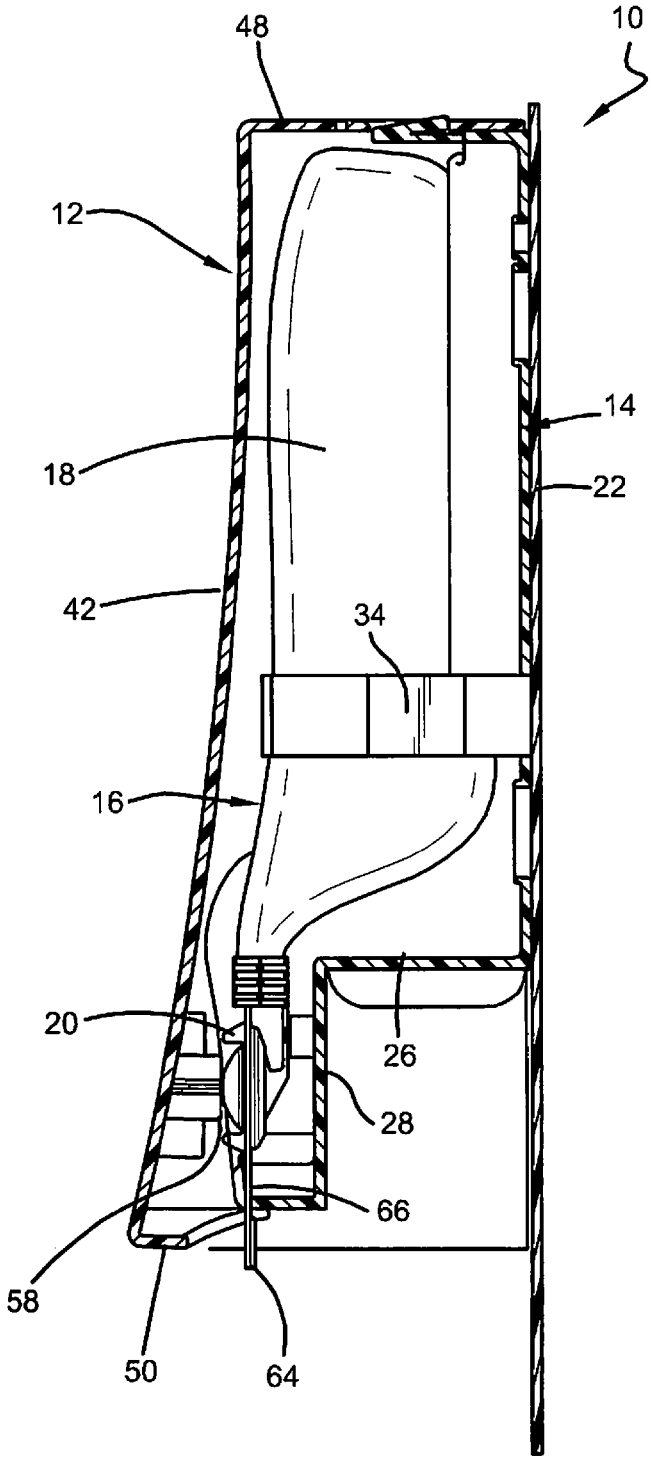
FIG. 5 is a sectional view of the dispenser in an unactuated position.

Referring now to FIGS. 4 and 5, operation of dispenser 10 will be discussed. Refill unit 16 is positioned within dispenser 10 and is supported by backplate 14. Product reservoir 18 rests on shelf portion 26 and is retained in position by sidewalls 30, 32 and product reservoir retaining element 34. Pump 20 is secured to a lower portion of product reservoir 18 and rests against pump support portion 28, which prevents horizontal movement of pump 20. An outlet nozzle 64 of pump 20 extends through a slot 66 in backplate 14, thereby further retaining pump 20 in the desired location. As can be seen in FIG. 4, actuating projection 58 is positioned adjacent to but not in contact with pump 20 when dispenser 10 is in an unactuated state. As shown in FIG. 5, when a force is applied to the lower portion of front surface 42, cover 12 deforms so that actuating projection 58 contacts and engages pump 20, thereby causing dispensing of a fluid through pump nozzle 64. When the force applied to cover 12 is removed, the cover will return the unactuated state. Thus, actuation of pump 20 is provided without necessitating a separate push bar mechanism or a pivoting cover.

Figure 6:
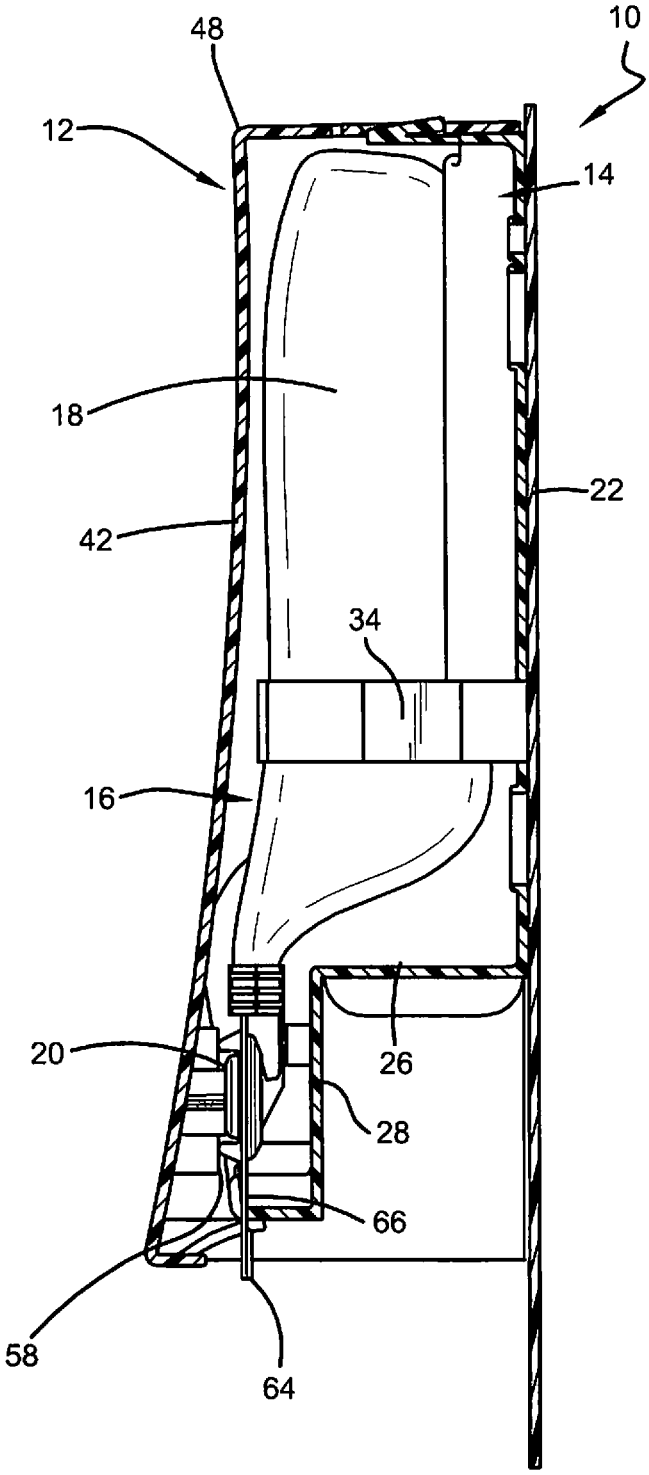
FIG. 6 is a sectional view of the dispenser in an actuated position.
Figure 7:
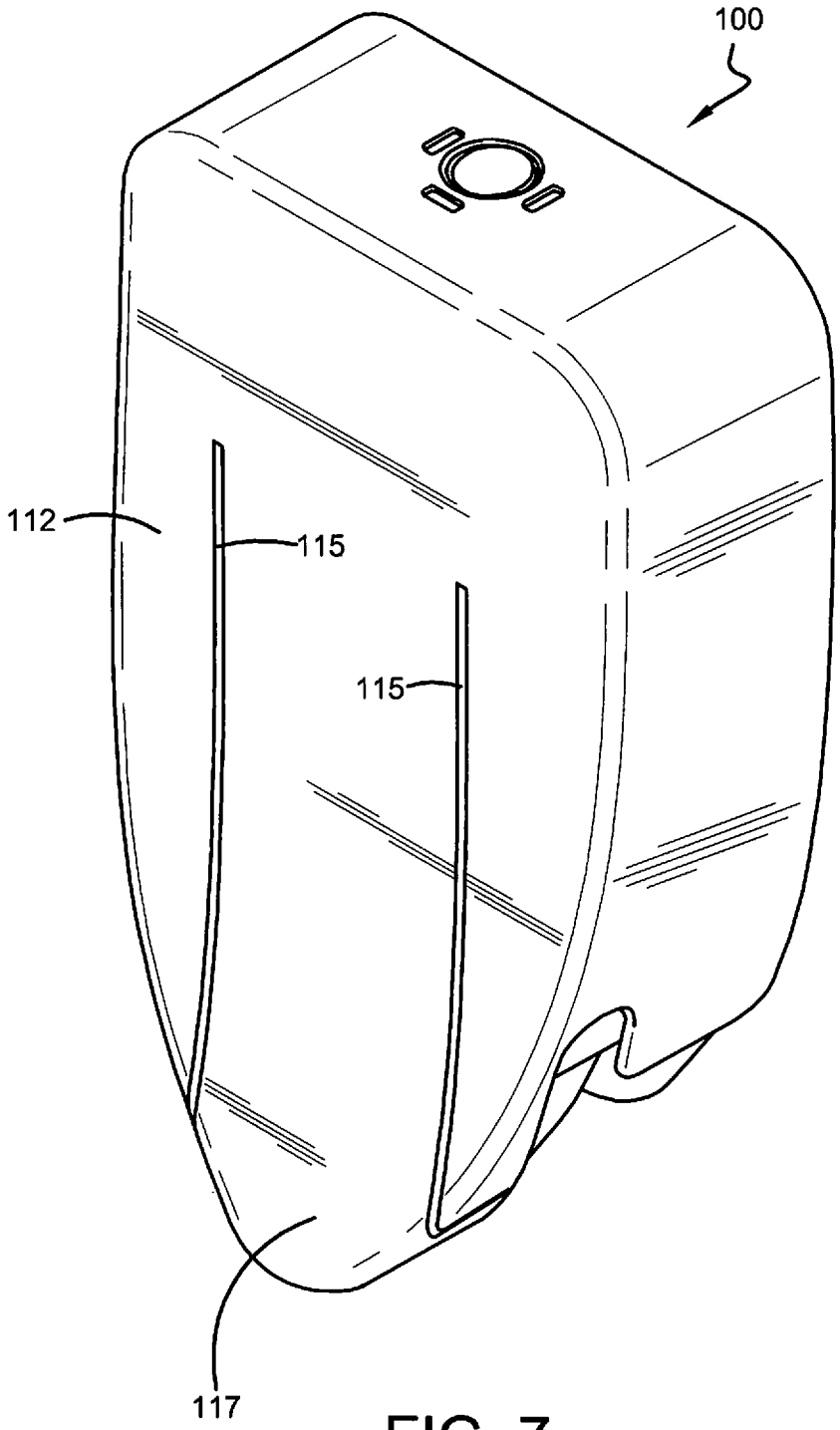
FIG. 7 is a perspective view of a dispenser according to the concepts of a second embodiment of the invention.

An alternative embodiment of the present invention is depicted in FIG. 6, and is generally indicated by the numeral 100. Dispenser 100 is substantially similar to dispenser 10 except for the differences discussed below. Dispenser 100 includes a flexible cover 112 including laterally spaced and vertically extending slots 115. Slots 115 extend from the bottom edge of cover 112 to a point below the top edge of cover 112. Slots 115 create a medial actuating arm 117 in cover 112 that flexes relative to the rest of cover 112 to actuate a pump (not shown) within dispenser 100. Thus, like dispenser 10, dispenser 100 may be actuated without necessitating a separate push bar mechanism or a pivoting cover due to the flexible nature of the cover.

It is thus evident that a dispenser constructed as described herein accomplishes the objects of the present invention and otherwise substantially improves the art. In accordance with the Patent Statutes, only the best mode and preferred embodiment have been presented and described in detail, and the invention should not be limited by that description. For an appreciation of the true scope and breadth of the invention, reference should be made to the following claims.

What is claimed is:

1. A dispenser comprising:

a backplate including a mounting portion; and a flexible cover deforming under pressure to cause dispensing of product, the cover including a front surface, a top surface, opposing side surfaces, and a bottom surface, the side surfaces each including a cut-out portion wholly within the side surface, each cut-out portion including a vertical top defining a flex point at which a lower portion of the cover deforms under pressure, wherein the cover is fixedly secured to the backplate so that it cannot pivot relative to the backplate.

2. The dispenser of claim 1, further comprising a refill unit supported by the backplate and including a product reservoir and a pump, the product reservoir holding the product dispensed by the deforming of said flexible cover.

3. The dispenser of claim 2, wherein the pump is a dome pump.

4. The dispenser of claim 1, wherein the backplate further includes a shelf portion extending outwardly from the mounting portion, and a pump support portion extending downwardly from the shelf portion opposite mounting portion.

5. The dispenser of claim 2, wherein the cover includes an inwardly extending actuating projection.

6. The dispenser of claim 5, wherein the actuating projection is positioned adjacent to the pump.

7. The dispenser of claim 1, further comprising laterally spaced sidewalls extending from the backplate along edges thereof.

8. The dispenser of claim 7, further comprising channels in an outer surface of the sidewalls, wherein the cover includes inwardly extending projections received in the channels.

9. The dispenser of claim 1, wherein the flex point defined by the cut-out portions of the side surfaces is defined at a vertical top of the cut-out portions.

10. The dispenser of claim 1, wherein the backplate has a tapered design so that the width of the backplate decreases adjacent a bottom edge thereof.

11. The dispenser of claim 10, wherein the cover has a corresponding tapered shape so that the width of the cover decreases adjacent a bottom edge thereof.

12. The dispenser of claim 6, wherein the cover deforms sufficiently under approximately 5 pounds of force to actuate the pump.

* * * * *